US010364010B2

(12) United States Patent
Coller et al.

(10) Patent No.: US 10,364,010 B2
(45) Date of Patent: Jul. 30, 2019

(54) MARINE PROPULSION UNIT

(71) Applicant: Global Packaging Systems, LLC, Victor, NY (US)

(72) Inventors: Thomas Charles Coller, Honeoye Falls, NY (US); Steven Donald Bush, Red Creek, NY (US); Keith Raymond Woerner, Canandaigua, NY (US)

(73) Assignee: Global Packaging Systems, LLC, Victor, NY (US)

( * ) Notice: Subject to any disclaimer, the term of this patent is extended or adjusted under 35 U.S.C. 154(b) by 534 days.

(21) Appl. No.: 15/162,241

(22) Filed: May 23, 2016

(65) Prior Publication Data

US 2017/0334535 A1 Nov. 23, 2017

(51) Int. Cl.

| | |
|---|---|
| ***B63H 20/10*** | (2006.01) |
| ***B63H 20/00*** | (2006.01) |
| ***B63H 20/28*** | (2006.01) |
| ***B63H 20/32*** | (2006.01) |

(52) U.S. Cl.

CPC ..... *B63H 20/10* (2013.01); *B63H 20/001* (2013.01); *B63H 20/28* (2013.01); *B63H 20/32* (2013.01)

(58) Field of Classification Search

CPC ..... B63H 20/001; B63H 20/28; B63H 20/32; B63H 20/02; B63H 21/30

See application file for complete search history.

(56) References Cited

U.S. PATENT DOCUMENTS

| | | | | | |
|---|---|---|---|---|---|
| 2,748,400 | A | * | 6/1956 | Kregall | B63B 1/24 114/281 |
| 2,996,035 | A | | 8/1961 | Torrey | |
| 4,232,627 | A | | 11/1980 | Glenn et al. | |
| 4,235,183 | A | * | 11/1980 | Evinrude | B63H 1/28 440/71 |
| 4,325,700 | A | * | 4/1982 | Kern | B63H 20/22 440/56 |
| 4,482,330 | A | * | 11/1984 | Cook | B63H 20/106 248/640 |
| 4,624,438 | A | | 11/1986 | Goodman, Jr. | |
| 5,007,869 | A | * | 4/1991 | Zoellner | B63H 5/165 114/274 |
| 5,100,349 | A | | 3/1992 | Perkins et al. | |
| 5,201,679 | A | | 4/1993 | Velte et al. | |
| 5,238,432 | A | * | 8/1993 | Renner | B63B 43/20 440/1 |

(Continued)

FOREIGN PATENT DOCUMENTS

| | | |
|---|---|---|
| JP | 62191297 | 8/1987 |
| JP | 09202298 | 8/1997 |

*Primary Examiner* — S. Joseph Morano
*Assistant Examiner* — Jovon E Hayes
(74) *Attorney, Agent, or Firm* — Patent Technologies, LLC; Robert D. Gunderman, Jr.

(57) ABSTRACT

A marine propulsion unit is described. The marine propulsion unit allows for shallow, obstructed, or otherwise impeded operation of a vessel through a novel marine propulsion transfer unit that is, or can be, mechanically coupled to an outboard motor or other similar marine motor. A mount for raising and lowering the marine propulsion unit in a generally vertical direction allows for adjustment of operating depth of the marine propulsion unit to accommodate a wide range of operating conditions from shallow and obstructed water to traditional deep water operation.

23 Claims, 17 Drawing Sheets

(56) References Cited

U.S. PATENT DOCUMENTS

| | | | | |
|---|---|---|---|---|
| 5,350,327 | A | 9/1994 | Self et al. | |
| 5,383,803 | A | 1/1995 | Pilgrim | |
| 5,634,833 | A * | 6/1997 | Watanabe | F01P 3/202 440/113 |
| 5,643,024 | A * | 7/1997 | Roberson, Jr. | B63H 20/32 440/76 |
| 5,741,165 | A | 4/1998 | Saito et al. | |
| 5,964,627 | A | 10/1999 | Detwiler | |
| 6,132,271 | A | 10/2000 | Hebert | |
| 6,361,388 | B2 | 3/2002 | Foreman | |
| 6,409,556 | B1 * | 6/2002 | Vance | B63H 20/106 248/640 |
| 6,561,859 | B1 * | 5/2003 | Towner | B63H 20/04 440/112 |
| 6,921,305 | B2 | 7/2005 | Provost | |
| 7,048,600 | B1 * | 5/2006 | Broussard | B63H 20/00 440/53 |
| 7,052,340 | B1 | 5/2006 | Broussard | |
| 7,297,035 | B2 | 11/2007 | Broussard | |
| 7,398,745 | B1 * | 7/2008 | White | F01P 5/14 123/41.01 |
| 8,267,025 | B2 * | 9/2012 | Witte | B63H 20/106 114/53 |
| 8,627,779 | B2 | 1/2014 | Witte | |
| 9,132,902 | B2 | 9/2015 | Angelle | |
| 2004/0132360 | A1 | 7/2004 | Kabakov | |
| 2006/0014445 | A1 | 1/2006 | Lawson et al. | |
| 2007/0123119 | A1 | 5/2007 | Provost | |
| 2012/0094554 | A1 | 4/2012 | Drinkard | |
| 2014/0038478 | A1 * | 2/2014 | Foreman | B63H 20/20 440/53 |
| 2017/0334535 | A1 * | 11/2017 | Coller | B63H 20/10 |

* cited by examiner

MARINE PROPULSION UNIT

BACKGROUND OF THE INVENTION

1. Field of the Invention

The present invention relates generally to propulsion systems for marine vessels, and more particularly to a marine propulsion unit for shallow and obstructed water operation and the various components thereof.

2. Description of the Related Art

There are various marine propulsion systems available today, the majority of which utilize a propeller to rotationally cut through the water in a helical manner, propelling the marine vessel at a speed proportional to the rotational speed of the propeller. There are also jet driven craft that use a pump to squirt a jet of water out the rear of the vessel to propel it forward, often very quickly. Both of these propulsion systems are prone to damage when operated in shallow or obstructed water. Often shallow water contains debris including branches, logs, rocks, weeds, and other obstacles that can quickly damage both propeller and jet driven vessels. As a result most boat operators do not venture into shallow, swampy, marshy, or otherwise obstructed water. While simply avoiding these water areas may not be a burden for many boaters, those that hunt, fish or engage in many other outdoor activities often find these generally non-navigable areas to be prime areas to access, if only there were a way to safely do so. In an attempt to fill this need, airboats came about. An airboat is a generally flat bottomed boat with a large engine attached to an aircraft style propeller. Since there are no moving parts below the water line, this style of boat is suitable for swampy, shallow and obstructed areas. Despite their usefulness, airboats are exceedingly loud, and are expensive to purchase and operate. As a result, various styles of what are commonly referred to as mud motors currently exist. Mud motors are attached to a flat bottomed boat such as a john boat, and look similar to an outboard motor, but have a long shaft with a propeller on the distal end that can be angled into or out of the water. This allows the propeller to spin in a partially submerged state, with the depth dependent on the type of obstructions encountered. For example, thick swamp like conditions would require the operator to move the drive shaft upward, in effect skimming across the weed and plant growth. Since the drive shaft of a mud motor must be angled by the operator based on the conditions encountered, operator fatigue often occurs. In addition, since the propeller is not always totally submerged, unsafe conditions can easily occur. One such condition occurs when the mud boat strikes a submerged or otherwise unseen obstacle and the operator is ejected from the boat. The torque of the mud motor will cause the now operator-less boat to drive in circles, repeatedly running over the operator who has been thrown from the boat. This condition, known by some as the circle of death, is one of the known risks of using many of the various mud motors. In addition, a mud motor is typically not well suited for traditional deep water operation, making it a specialty item with limited applicability. Current, mud motors are custom manufactured, on a very small scale compared with mass produced outboard motors, making replacement parts costly and the continued availability of replacement parts an ongoing concern.

What is needed is a marine propulsion unit for shallow and obstructed water operation that is safe, can also be used for traditional deep water operation, and incorporates a standard outboard motor.

It is thus an object of the present invention to provide such a marine propulsion unit as will be further described herein. These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a marine propulsion transfer unit comprising a driveshaft housing for extending the driveline of an existing outboard motor; a marine propulsion transfer unit driveline comprising an adapter for coupling to an output shaft of the driveline of an existing outboard motor, a misalignment coupling, and an output shaft adapted to receive a propeller; the marine propulsion transfer unit driveline being retained by the driveshaft housing; and at least one attachment to connect the driveshaft housing to the existing outboard motor and extend the driveline of the existing outboard motor. A marine propulsion unit is also provided that includes the marine propulsion transfer unit with an outboard motor operatively coupled therewith. A mount for shallow obstructed water operation of the marine propulsion transfer unit is also provided, the mount comprising a transom mount, an outboard motor mount plate slidably engaged with the transom mount to vertically raise and lower an outboard motor, a submerged obstruction hinge assembly, and a reverse lockout component. A kit for converting an existing outboard motor to an outboard motor for shallow obstructed water operation is also provided. The kit comprises the marine propulsion transfer unit and the mount for shallow obstructed water operation of the marine propulsion transfer unit.

The foregoing paragraph has been provided by way of introduction, and is not intended to limit the scope of the invention as described by this specification, claims and the attached drawings.

BRIEF DESCRIPTION OF THE DRAWINGS

The invention will be described by reference to the following drawings, in which like numerals refer to like elements, and in which.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, claims, and drawings attached hereto.

DESCRIPTION OF THE PREFERRED EMBODIMENTS

The marine propulsion unit of the present invention allows for shallow or obstructed water navigation through a novel transfer unit that is mechanically coupled to an outboard motor. Such an arrangement provides for a reliable and lower cost shallow water marine propulsion unit due in part to the use of a standard production outboard motor as a platform. Ongoing operational costs are further expected to be lower due to the use of a standard platform. In addition, and as will become evident after reviewing the description set forth herein, the novel mount that provides for shallow or obstructed water operation also allows the marine propulsion unit to operate in deep water akin to a traditional outboard motor, and allows for an easy transition from one operating environment to another, something that heretofore not been attained by any form of marine propulsion unit. Additionally, the marine propulsion transfer unit allows for the retrofit of an existing outboard motor in addition to offering an overall marine propulsion unit complete with an attached outboard motor, and in some embodiments of the present invention, a novel mount to allow for vertical adjustment of the marine propulsion unit along with submerged obstruction and lockout components. These various constituent components of the present invention may be provided. Individually, as a complete unit or system, or in a kit or component form. The descriptions of each of these constituent components and their interaction and elements thereof being further described as follows.

Figure 1:
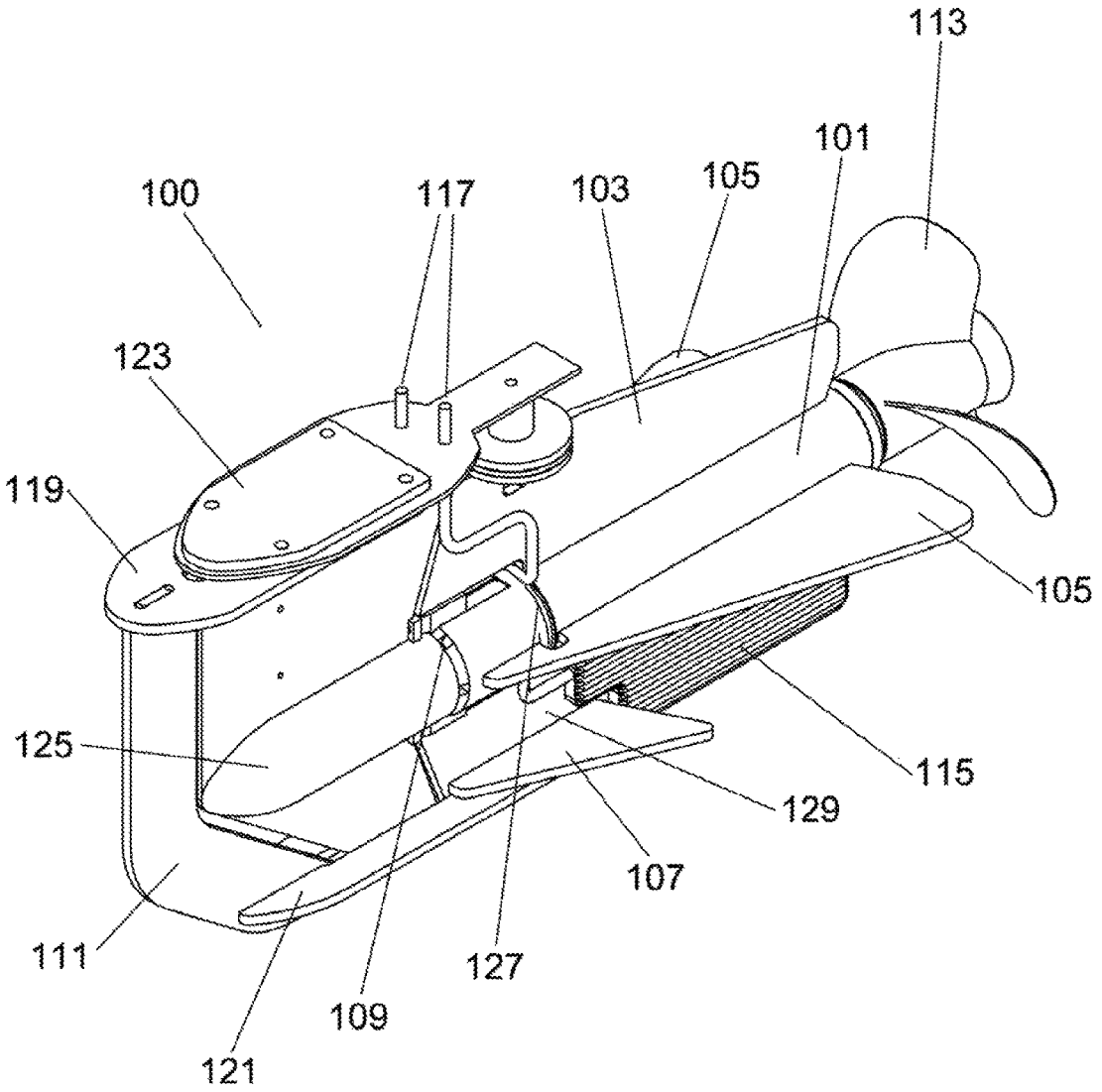
FIG. 1 is a perspective view of a marine propulsion transfer unit of the present invention.

FIG. 1 depicts a perspective view of a marine propulsion transfer unit 100 that may be attached to an outboard motor or similar marine motor. The marine propulsion transfer unit 100 contains a driveline that can be seen in FIG. 6 that is contained by a driveshaft housing 101. The driveshaft housing 101 as well as the various components of the marine propulsion transfer unit 101 are made of a suitable structurally sufficient material such as aluminum, steel, stainless steel, brass, and in certain applications, a plastic or a composite material. Techniques for fabricating the various components include, but are not limited to, casting, machining, molding, stamping, pressing, welding, forming, and the like. The driveshaft housing 101 allows for a generally horizontally disposed driveline that extends the driveline 125 of an existing outboard motor. While the driveshaft housing 101 may be generally tubular or cylindrical in some embodiments to accommodate rotational driveline elements, various components and features are contained thereon to further facilitate proper operation of the marine propulsion transfer unit. These various components and features may be modified in shape, form and structure, or in some embodiments eliminated entirely, without departing from the spirit and broad scope of the present invention as described, depicted and envisioned herein. For example, an upper support fin 103 can be seen in FIG. 1 that provides not only structural integrity to the marine propulsion transfer unit 101, but also provides hydrodynamic attributes to the marine propulsion unit that contribute to performance. In some embodiments, the upper support fin is attached to an upper portion of the driveshaft housing in a generally vertical orientation.

An upper stabilizer assembly 105 can also be seen attached where two upper stabilizers are each attached to opposing side areas of the driveshaft housing. In some embodiments of the present invention, each upper stabilizer is generally triangular in shape, and may, in some embodiments, have a rounded or tapered corner, an angled side, or the like. At the bottom area of the driveshaft housing 101 a skeg 129 can be seen. The skeg 129 protrudes downward from the bottom area of the driveshaft housing 101 and may, in some embodiments of the present invention, track or otherwise conform to the existing skeg of the outboard motor that the marine propulsion transfer unit 100 is attached to. A lower stabilizer assembly 107 can also be seen that comprises two lower stabilizers attached to opposing sides of the skeg 129. In some embodiments of the present invention, the lower stabilizers are generally triangular, and may have, in some embodiments, a rounded corner with angled sides, tapered sides, or the like.

At the area where the driveshaft housing meets the existing outboard structure, or thereabouts, discharge ports 109 can be seen. These discharge ports allow for the venting of exhaust gases from the outboard motor and also allow for movement of water. The discharge ports 109 may be circumferentially arranged slotted, rectangular, circular, or other such geometries that facilitate proper movement of gases and water.

A front guard assembly 111 can be seen that provides protection of the marine propulsion unit from underwater obstacles that could otherwise inflict damage on the marine propulsion unit while in motion. The front guard assembly may be shaped to conform to the leading edge of the outboard motor, and may, in some embodiments of the present invention, be shaped similar to a boomerang, hockey stick blade, or the like. The angled or otherwise shaped front guard assembly 111 is retained by an upper attachment 119 that further serves to retain and stabilize the marine propulsion transfer unit 100 to the outboard motor. A lower section of the outboard motor 123 is attached to, or otherwise coupled to, the upper attachment 119. A lower attachment 121 ties the front guard assembly 111 into the skeg area 129 of the marine propulsion transfer unit 100.

Attached to the skeg 129 is a cooling structure 115 that is a heat exchanger having channels for the movement of cooling fluid from the outboard motor by way of cooling lines 117. The cooling fluid is moved by way of a mechanical pump or impeller from the outboard motor through the channels in the cooling structure 115 for the removal of heat from the outboard motor. Cooling line channels 127 can be seen on the driveshaft housing 101 to recess and protect the cooling lines 117. Additional cooling means, such as, but not limited to, the heat exchanging seat 2100 (see FIG. 21), may also be employed.

Figure 6:
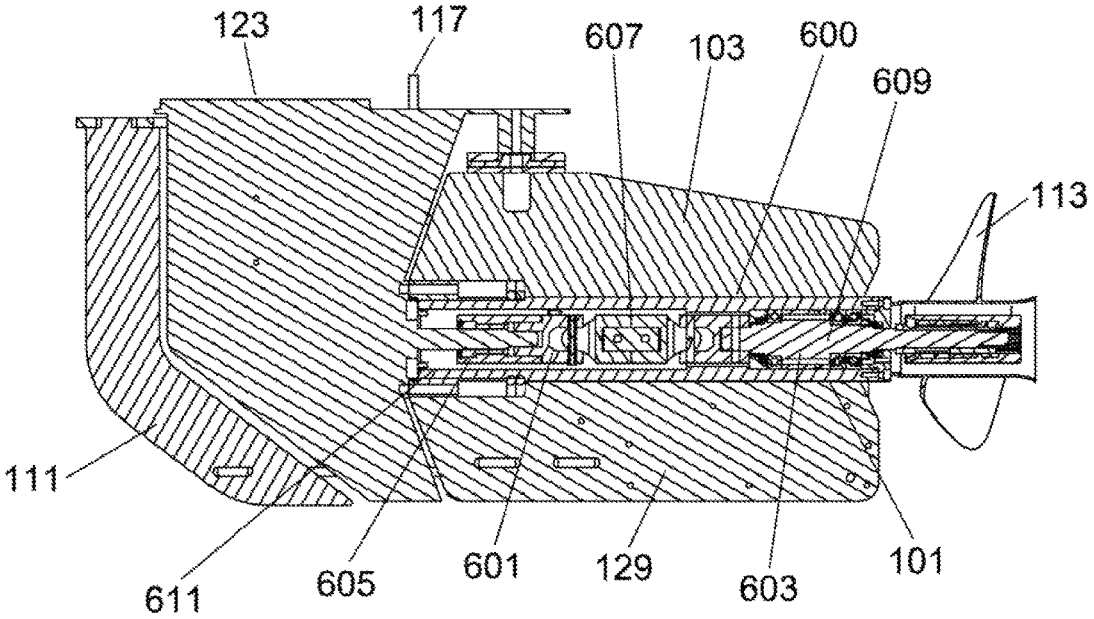
FIG. 6 is a cross-sectional view of the marine propulsion transfer unit taken along line A-A of FIG. 5.

A propeller 113 can also be seen in FIG. 1. The propeller 113 is mechanically coupled to an output shaft that is depicted in FIG. 6. The propeller 113 may be a standard propeller intended for use on a traditional outboard motor, or may, in some embodiments, be a specialized propeller for shallow or obstructed water operation. The propeller 113 may be provided by, or changed by, the owner/operator of the marine propulsion unit similar to how a propeller is changed with a traditional outboard motor.

It should be noted that the length of the overall driveline of the marine propulsion transfer unit 100 may vary based on the intended application, overall output power of the host outboard motor, boat geometry and hull design, and the like. The driveline of the marine propulsion transfer unit can be further seen and described by way of FIG. 6 and the associated callout 600. It should also be noted that the geometry of the marine propulsion transfer unit 100, including but not limited to the angle by which the driveline attaches to the host outboard motor output shaft (seen as 611 in FIG. 6) may vary, these variations being considered an important part of the overall spirit and broad scope of the present invention and the various embodiments therein.

Figure 2:
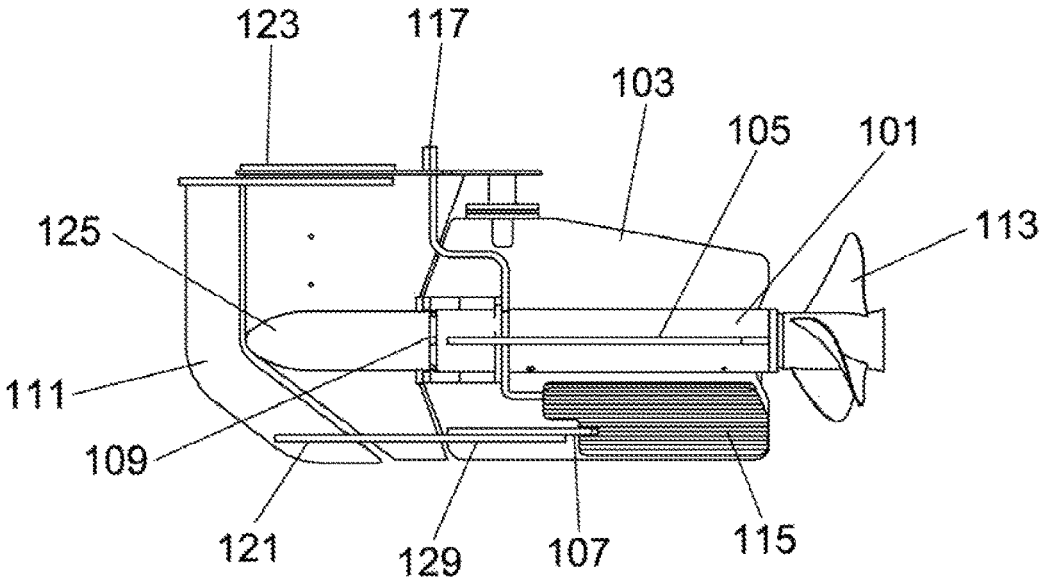
FIG. 2 is a side view of the marine propulsion transfer unit.

To further depict the marine propulsion transfer unit 100 and the cooperation of the marine propulsion transfer unit 100 with a host outboard motor. FIG. 2 is a side view of the marine propulsion transfer unit with a portion of a host outboard motor also shown (specifically, the driveline of the outboard motor 125 and the lower section of the outboard motor 123).

Figure 3:
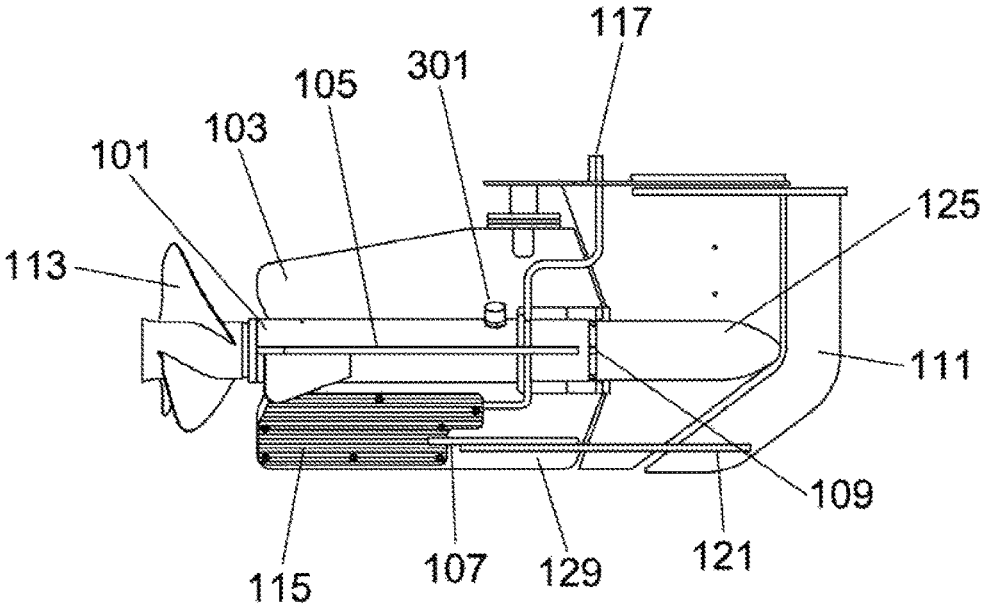
FIG. 3 is an alternate side view of the marine propulsion transfer unit.

FIG. 3 is an alternate side view of the marine propulsion transfer unit 100. A garden hose fitting 301 can be seen that is in fluid communication with an open driveline section as will be further depicted as 601 in FIG. 6. The placement of the garden hose fitting 301 may vary, but must be in communication with the open section of the driveline, again as will be further seen in FIG. 6. The purpose of the garden hose fitting 301 is to allow for clean out of the open driveline section with a garden hose and water. Flushing the open driveline section with water removes mud, weeds, fine organic materials such as duckweed, small sticks, gravel, and other unwanted materials that could compromise the functionality of the marine propulsion transfer unit 100, block the discharge ports 109, or create other maladies.

Figure 4:
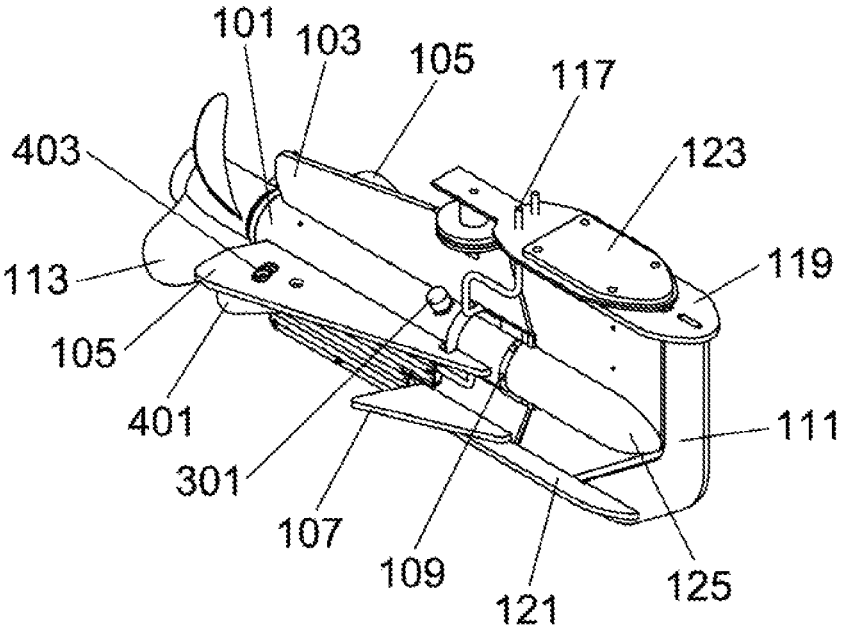
FIG. 4 is a frontal perspective view of the marine propulsion transfer unit.

Turning now to FIG. 4, a frontal perspective view of the marine propulsion transfer unit 100 can be seen. From this angle, a torque compensating trim tab 401 can be seen attached to the upper stabilizer assembly 105. While other mounting locations may also be employed, the use of the upper stabilizer assembly 105 provides a convenient location that allows for an adjustment point 403 and is hydrodynamically efficient. The adjustment point 403 may include a set screw with a recess or similar structure in the upper stabilizer assembly 105. The adjustment point 403 allows one to vary the angle of the torque compensating trim tab 401 to provide a counteracting force from the movement of the marine propulsion transfer unit 100 through the water while in operation. This counteracting force acts to offset the torque from the overall marine propulsion unit in operation, thus providing improved steering and tracking of the boat while in use.

Figure 5:
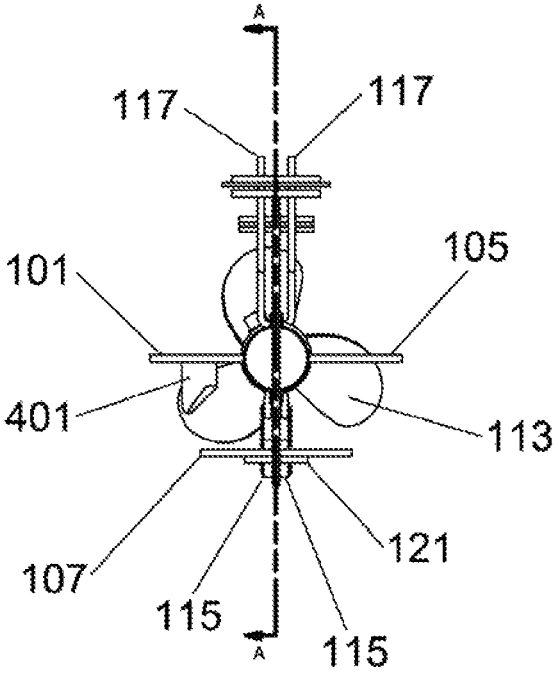
FIG. 5 is a rear facing view of the marine propulsion transfer unit.

FIG. 5 is a rear facing view of the marine propulsion transfer unit 100 showing the constituent components that have been heretofore described.

FIG. 6 is a cross-sectional view of the marine propulsion transfer unit taken along line A-A of FIG. 5 to show the internal components that make up the marine propulsion transfer unit driveline 600. This driveline transfers rotational energy from the outboard motor output shaft 611 to the marine propulsion transfer unit output shaft 609. The outboard motor output shaft 611 initially accommodated a propeller which has been removed in order to accommodate attachment of the marine propulsion transfer unit 100. As can be seen, the marine propulsion transfer unit output shaft 609 is capable of retaining a propeller 113, as previously described. The marine propulsion transfer unit driveline 600 comprises an open driveline section 601 and a sealed driveline section 603. The open driveline section 601 is open to the water environment in operation, and passes both water and exhaust gas through the discharge ports 109 (see FIG. 1). The sealed driveline section 603 is closed to the water environment, and contains grease or a similar lubricant to surround and lubricate the rotational components contained therein. Beginning with the outboard motor output shaft 611, a drive shaft adapter 605 is used to connect the outboard motor output shaft 611 to the driveline 600 of the marine propulsion transfer unit 100. The drive shaft adapter 605 may be a spline adapter or similar anti-rotation structure to accommodate the existing outboard motor output shaft 611 features. A misalignment coupling 607 such as a universal joint, constant velocity (CV) joint, double universal joint or the like, can be seen coupling the drive shaft adapter 605 and related input section of the marine propulsion transfer unit driveline 600 to a marine propulsion transfer unit output shaft 609. The marine propulsion transfer unit output shaft 609 exits the marine propulsion transfer unit 100 and comprises anti-rotation fittings such as splines, hexagonal features, or the like. Further details of the marine propulsion transfer unit driveline 600 can be seen in FIG. 8 including seals that delineate the open driveline section 601 from the sealed driveline section 603.

Figure 7:
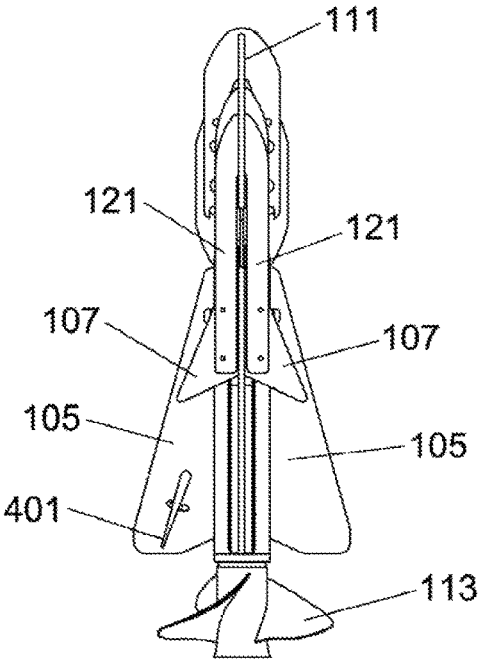
FIG. 7 is a bottom view of the marine propulsion transfer unit.

FIG. 7 is a bottom view of the marine propulsion transfer unit. The torque compensating trim tab 401 can be clearly seen in an offset position that can be adjusted to suit the boat and motor combination and the preferences of the operator.

Figure 8:
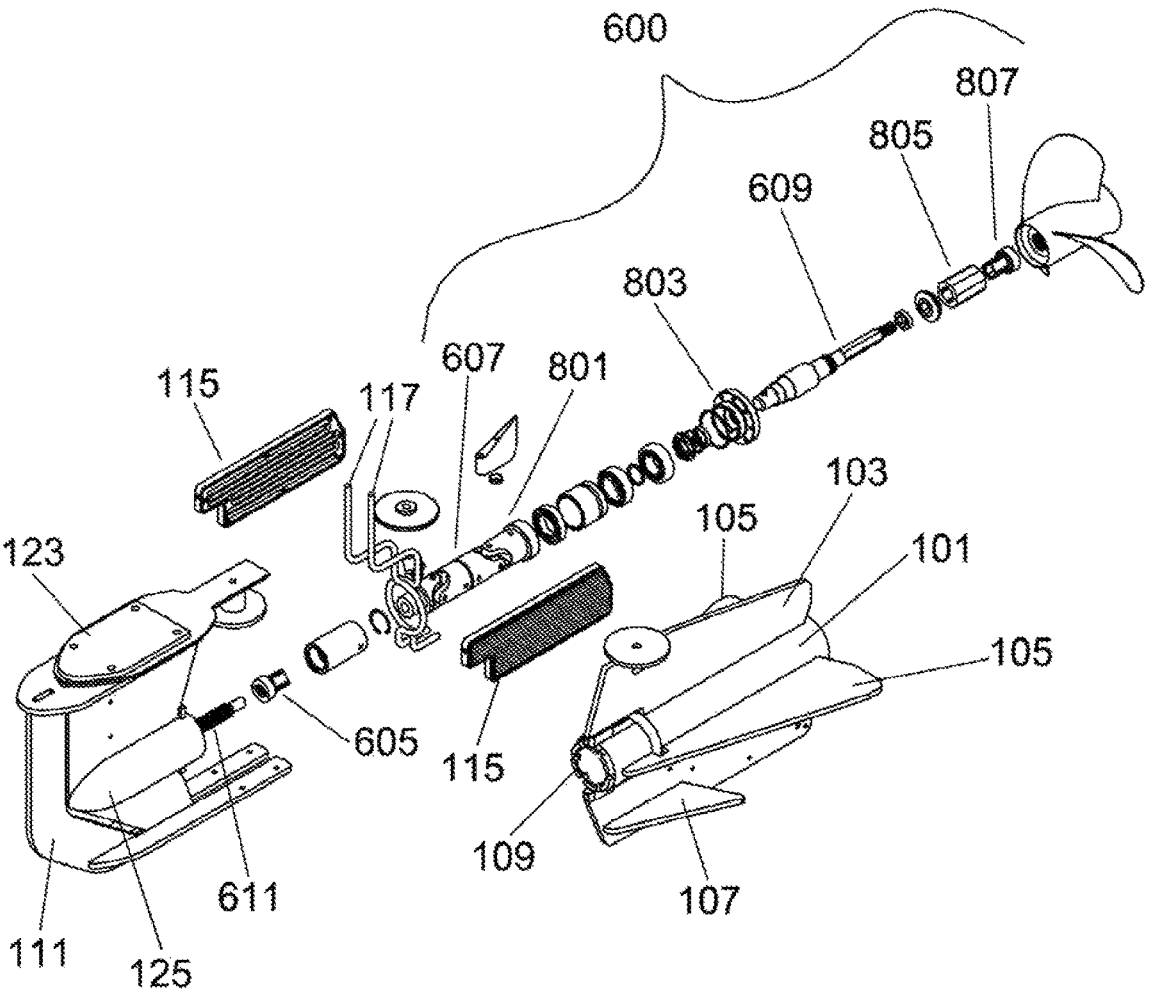
FIG. 8 is an exploded perspective view of the marine propulsion transfer unit.

FIG. 8 is an exploded perspective view of the marine propulsion transfer unit showing the various components that make up the marine propulsion transfer unit driveline 600. A plurality of bushings, spacers, washers, bearings and driveline related items can be seen. Various embodiments of the present invention may employ differing driveline related items, and the exploded perspective view depicted is intended to provide a working example, and not a limitation, of the present invention. A first seal 801 and a second seal 803 can be seen to provide retention of a lubricant such as a grease. The marine propulsion transfer unit output shaft 609 accommodates a sacrificial cushion hob 805 and a related insert 807 that rotationally secures a propeller or driveline component while providing protection to the marine propulsion transfer unit 100 and host outboard motor in the event that an obstacle is encountered by the propeller that would be sufficient to create damage due to sudden deceleration of propeller rotation upon impact. The sacrificial cushion hub 805 is made from a material such as a plastic or soft metal that will break apart with sufficient shear force such as that which would be encountered should an obstruction impede the rotation of the propeller. This sacrificial hub arrangement will prevent damage that would otherwise occur when encountering an obstruction. The insert 807 may also contain anti-rotation features that cooperatively engage with the sacrificial cushion hub 805 such as splines, planar faces, or the like.

The marine propulsion transfer unit 100 is thus attached to a host outboard motor using the hardware attributes provided herein. A closed loop cooling system may optionally be employed that seals of the exiting open loop cooling system of the outboard motor and utilizes cooling lines and cooling structures of the marine propulsion transfer unit 100.

In a standard outboard marine engine, host water is drawn into the lower end of the outboard through an intake by way of a rubber impellor pump. The impellor pumps the water up into the base of the engine block. The water then circulates through the engine block and head(s). Water from the head loop is then pumped through the gas pumps. This cooling of the fuel loop prevents what is known as vapor lock. The water flowing through the block is drained though the bottom of the block into the exhaust system and back into the host water. This continued circulation of cold water, referred to here as host water, prevents the engine from overheating and allows the engine to run at a preferred temperature that is controlled by the opening and closing of a thermostat valve in the cooling loop.

With the marine propulsion unit of the present invention, this open loop host water system is modified so that the marine propulsion unit has a closed loop cooling system, as the host water in which the marine propulsion unit of the present invention is usually full of unwanted material such as weeds, mud, silt, organic matter, gravel, and the like, all of which would destroy an open loop cooling system in short order.

The marine propulsion unit of the present invention works by changing such a typical open loop cooling system into a closed loop system through modification of an existing outboard motor cooling system. By way of example, and not limitation, a typical in-line 3 or 4 cylinder outboard motor is converted by the following steps, which may be modified, adapted or changed depending on the specific manufacturer's outboard motor configuration.

Steps

- Remove factory supplied pump in the lower unit
- Disconnect visual water drain
- Remove exhaust cover
- Remove factory thermostat
- Close engine lower water drain port in exhaust area
- Add new ⅜ NTP water connection to serve as engine block drain in exhaust cover
- Route and combine the two exhaust lines to return to radiator that is in the boat
- Mount motor to engine
- Route radiator drain port to new water pump intake
- Route pump exit to lower unit secondary cooling loop
- Route secondary cooling loop exit to engine water intake Once this new closed loop system is prepared and assembled, the new loop will maintain an outboard engine at acceptable running temperatures using 100% recirculated water. Hot water is exhausted from the engine and fed into the primary cooling radiator. The electric fan of the radiator assembly, such as that depicted in FIGS. 21-24, draws air in past the cooling fins and drops the coolant temperature of the water/glycol mix by a minimum of 15-25 degrees Fahrenheit by the time it exits the pump bleed. The pump feeds the semi cool water into the lower unit's secondary cooling structure 115 which cools the water another 15-35 degrees Fahrenheit. The water then exits the secondary cooler and enters the engine to complete the loop.

To ensure proper operation of the marine propulsion unit (which comprises an outboard motor and the marine propulsion transfer unit), a mount for shallow and obstructed water operation is provided. The mount comprises a transom mount, an outboard motor mount plate slidably engaged with the transom mount to vertically raise and lower an outboard motor, a submerged obstruction hinge assembly, and a reverse lockout component. The mount allows an operator to change the operating depth of the marine propulsion unit of the present invention based on the water conditions encountered. This allows versatility of operation from deep water to shallow water, mud water, marsh, swamp, and the like.

Figure 9:
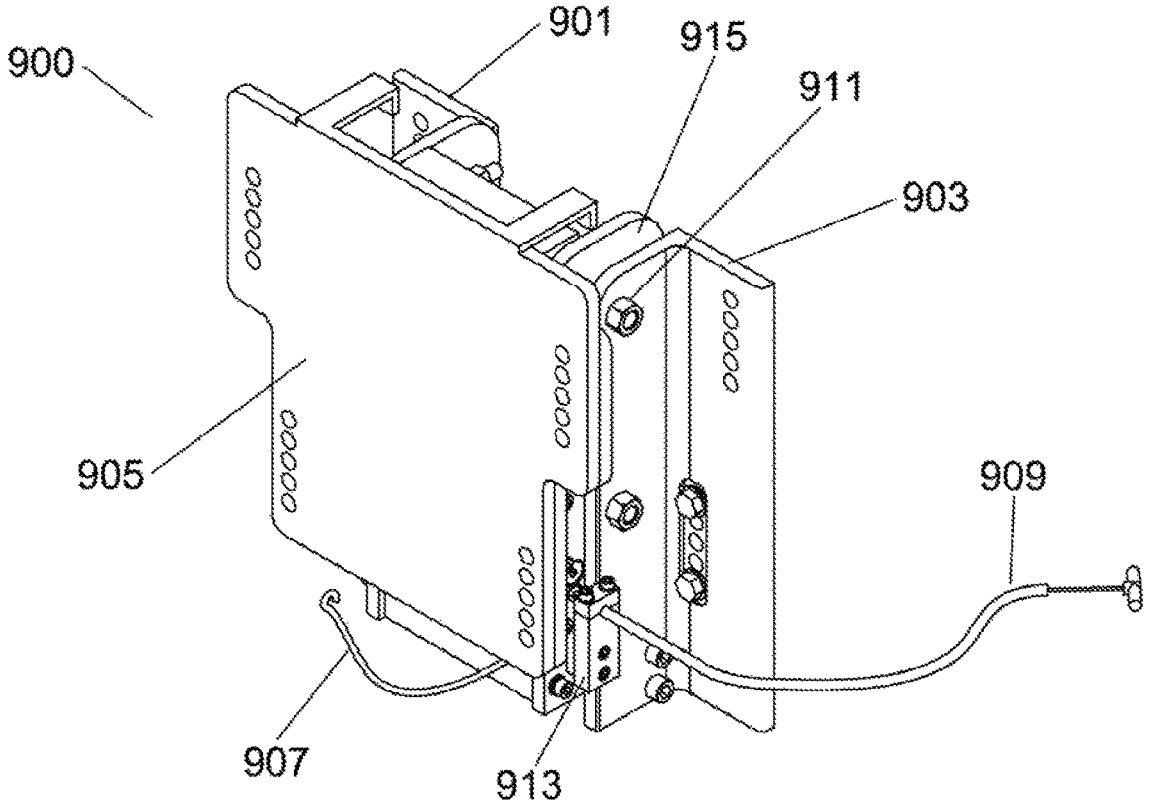
FIG. 9 is a perspective view of the mount for shallow and obstructed water operation.
Figure 18:
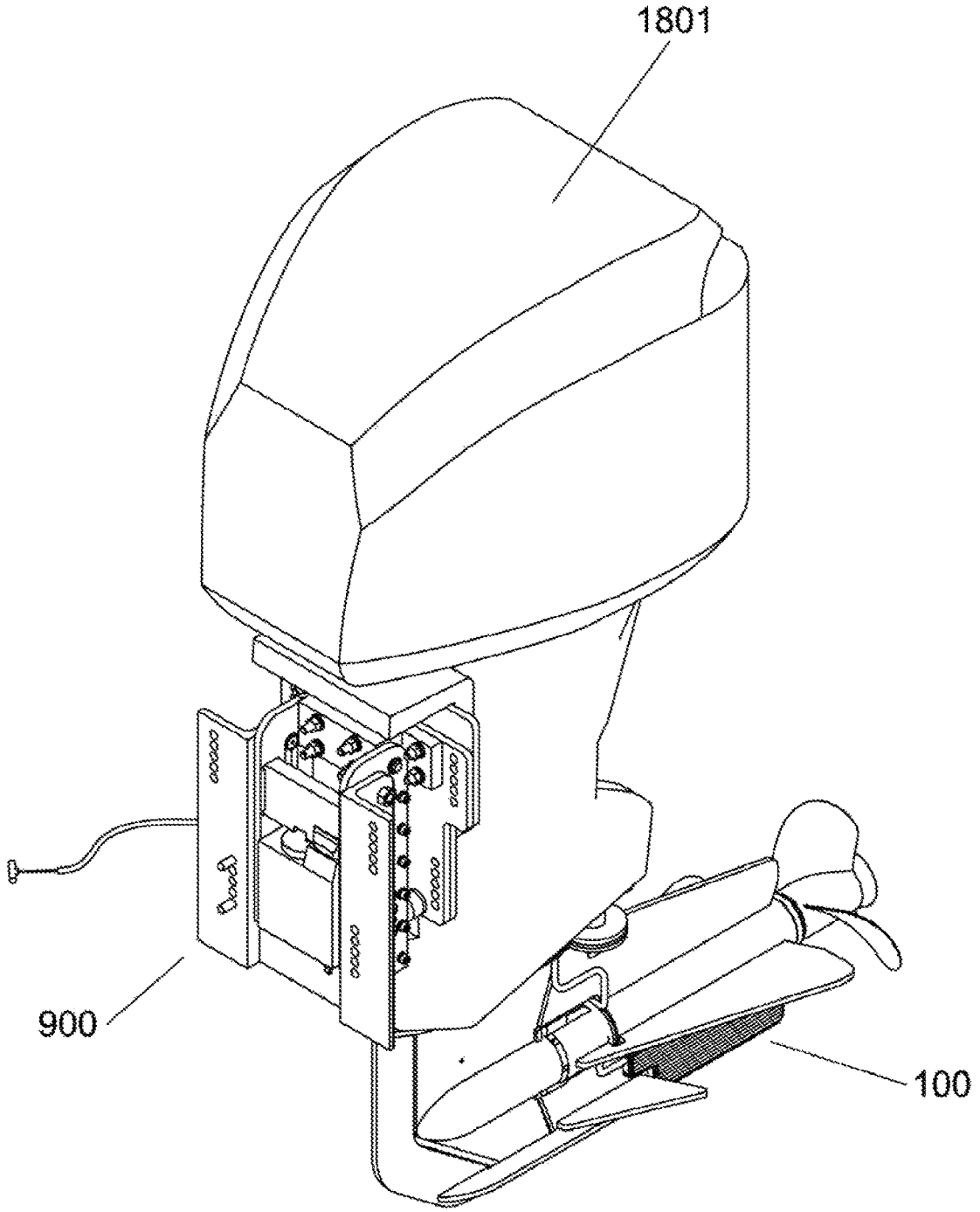
FIG. 18 is a perspective view of a marine propulsion unit with mount.

FIG. 9 is a perspective view of the mount for shallow and obstructed water operation 900. A port transom mount 901 and a starboard transom mount 903 can be seen, and provide attachment points for the mount 900 to a transom of a boat (see FIG. 25). An outboard motor mount plate 905 is slidably engaged with the transom mounts) and allows an outboard motor to be attached to the mount plate 905 using bolts or other fasteners. FIG. 18 depicts such attachment. A submerged obstruction hinge assembly 911 engages with a cam plate 915 and allows the marine propulsion unit to swing up and clear an obstruction and avoid catastrophic damage. A safety lanyard 907 such as a braided cable prevents over travel of the marine propulsion unit when swinging upward to clear an obstruction. A reverse lockout component 913 can also be seen that engages with the submerged obstruction hinge assembly 911 in such a way as to prevent the marine propulsion unit from swinging upward while operating in reverse. To facilitate ease of use, a reverse lock cable 909 allows for remote operation of the reverse lockout component 913, and may, in some embodiments, be integral with a throttle assembly for even further convenience. Further, in some embodiments, electronic actuators such as, but not limited to, solenoids or other electromechanical components, may be employed to facilitate such integration.

Figure 10:
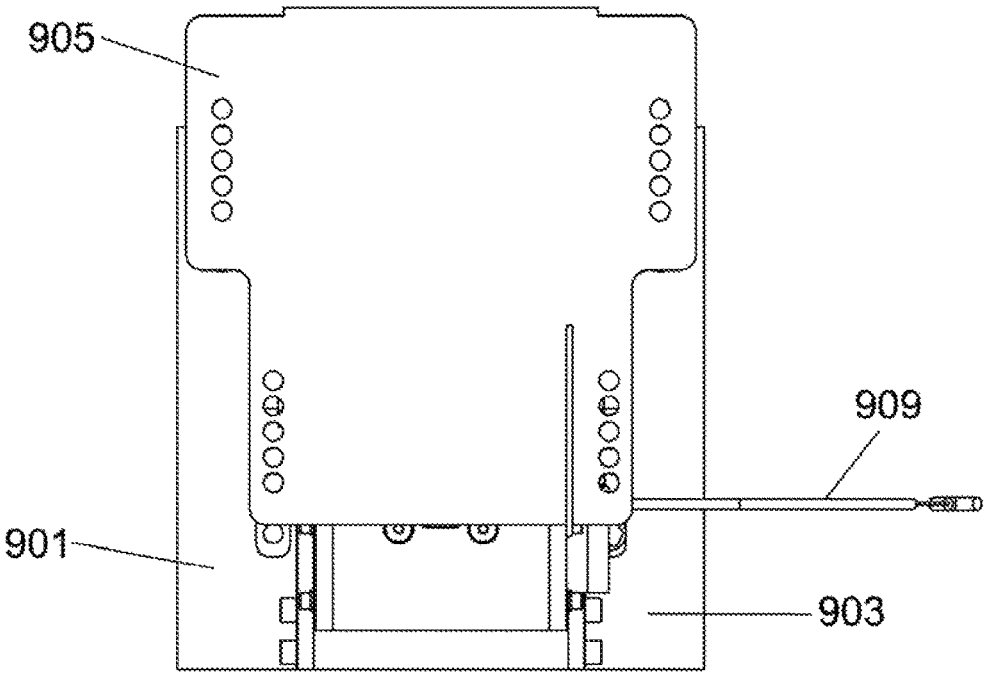
FIG. 10 is a plan view of the mount of FIG. 9.

FIG. 10 is a plan view of the mount of FIG. 9 clearly showing the outboard motor mount plate 905.

Figure 11:
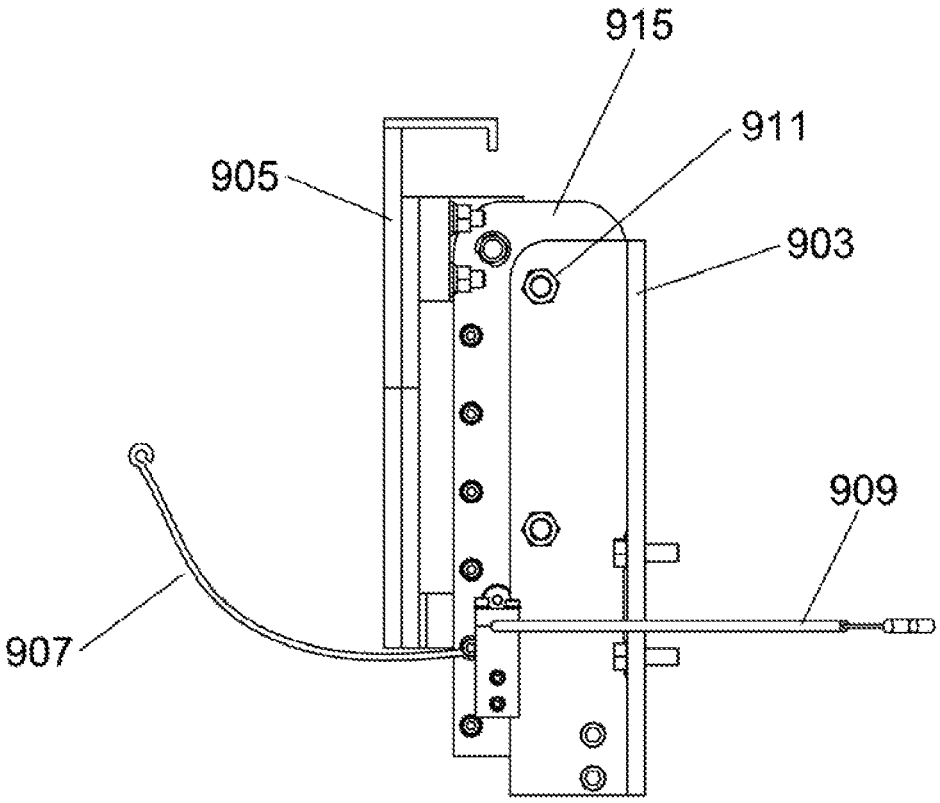
FIG. 11 is a side view of the mount of FIG. 9 in the deep water position.

FIG. 11 is a side view of the mount of FIG. 9 in the deep water position, which is evident by the position of the outboard motor mount plate 905 with respect to the starboard transom mount 903 that is visible from the side view shown.

Figure 12:
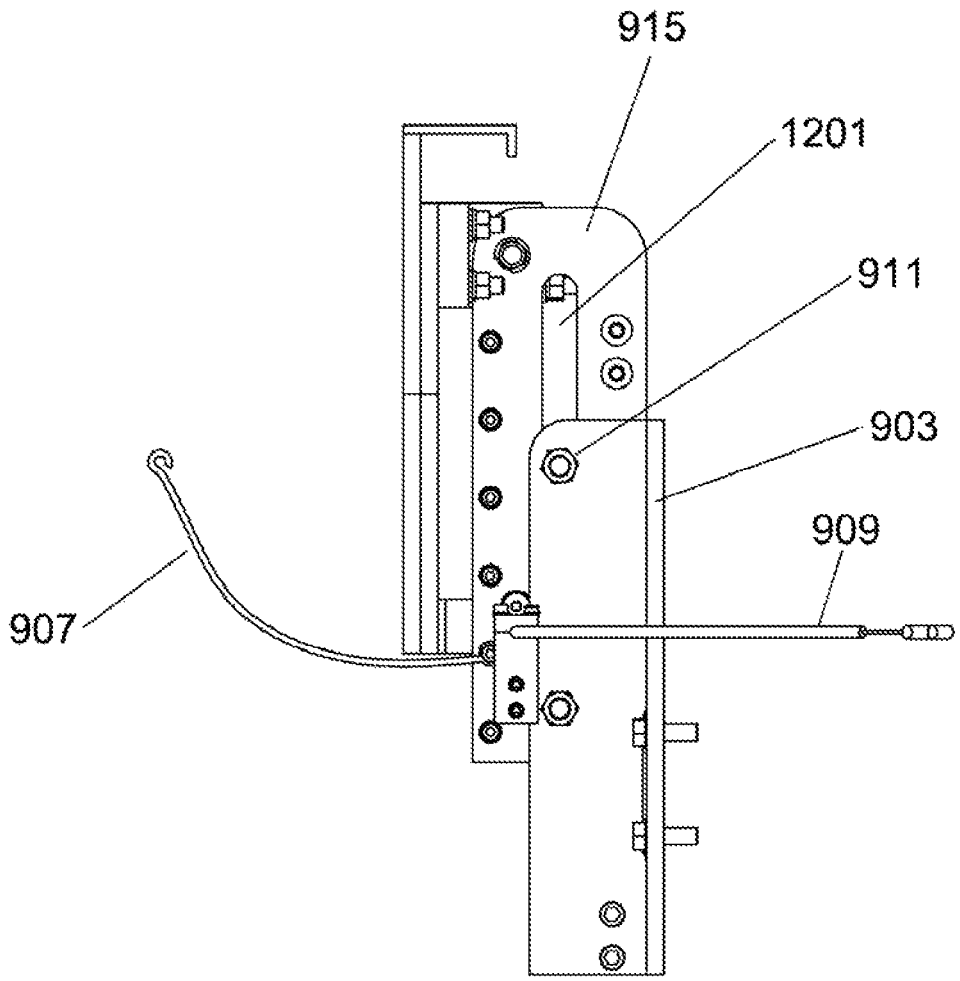
FIG. 12 is a side view of the mount of FIG. 9 in the shallow water position.

FIG. 12 is a side view of the mount of FIG. 9 in the shallow water position, as evident by the extension of the outboard motor mount plate 905 with respect to the starboard transom mount 903 that is visible from the side view shown. A slot 1201 can also be seen that facilitates movement of the hinge assembly and related vertical displacement of the outboard motor mount plate 905 with respect to the starboard transom mount 903.

Figure 13:
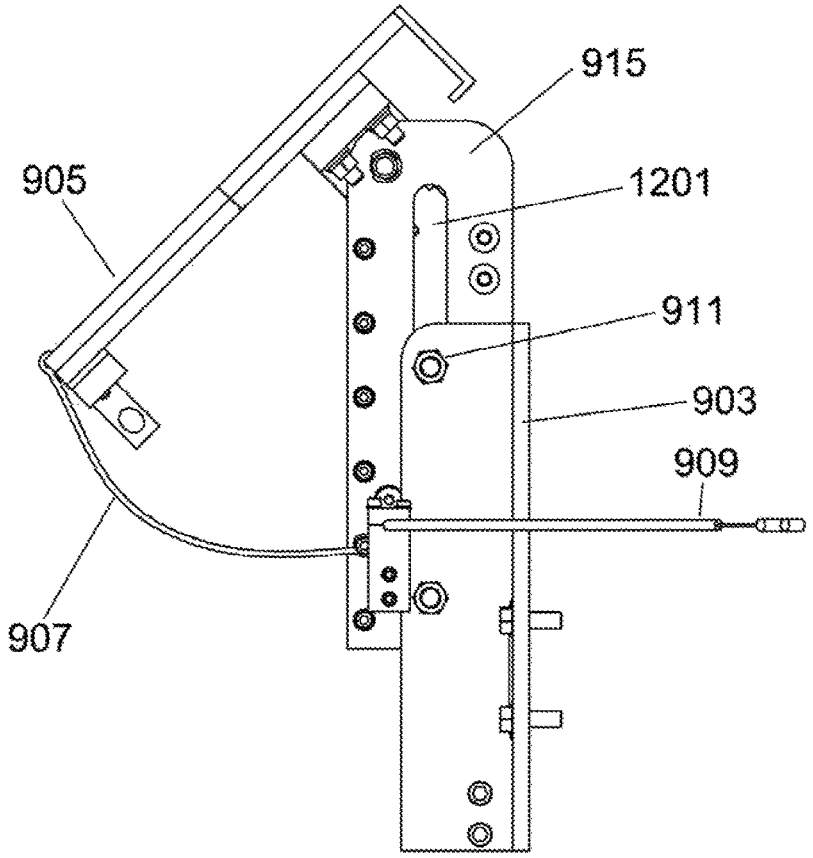
FIG. 13 is a side view of the mount of FIG. 9 in a shallow water kicked out position.
Figure 14:
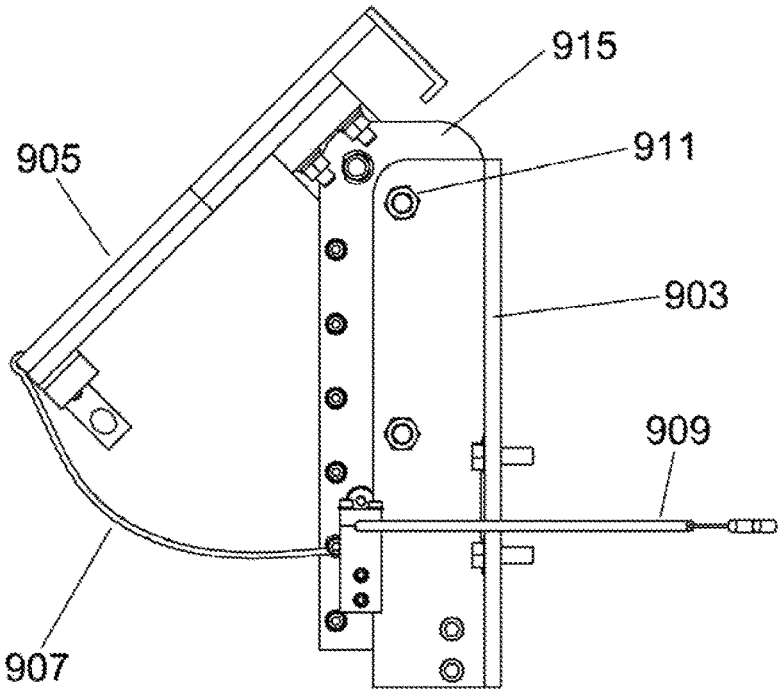
FIG. 14 is a side view of the mount of FIG. 9 in a deep water kicked out position.

FIG. 13 is a side view of the mount of FIG. 9 in a shallow water kicked out position, and FIG. 14 is a side view of the mount of FIG. 9 in a deep water kicked out position.

Figure 15:
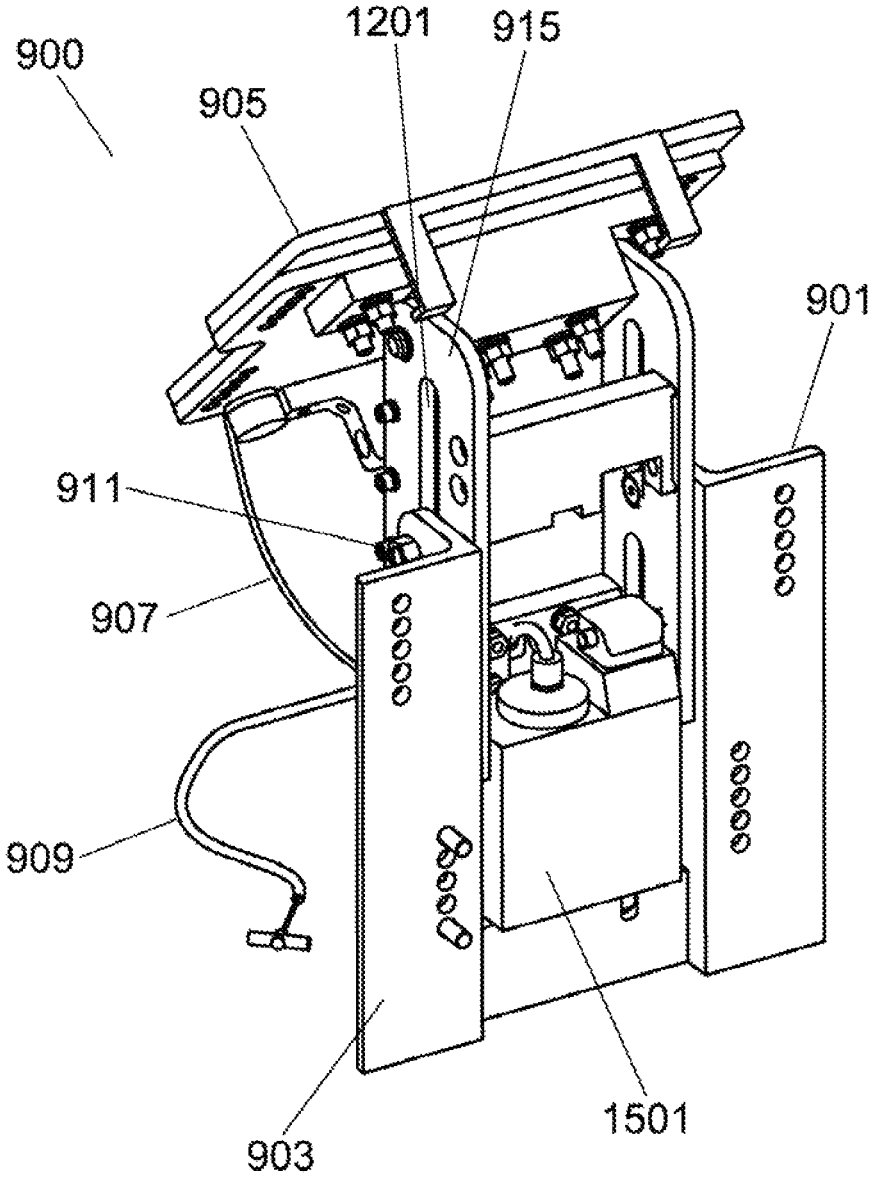
FIG. 15 is a rear perspective view of the mount of FIG. 9 showing the hydraulics.

FIG. 15 is a rear perspective view of the mount of FIG. 9 showing the hydraulics. As the outboard motor and related marine propulsion transfer unit that make up the marine propulsion unit may be rather large and heavy, a hydraulic module 1501 may be employed to facilitate raising and lowering the vertical operating position of the marine propulsion unit.

Figure 16:
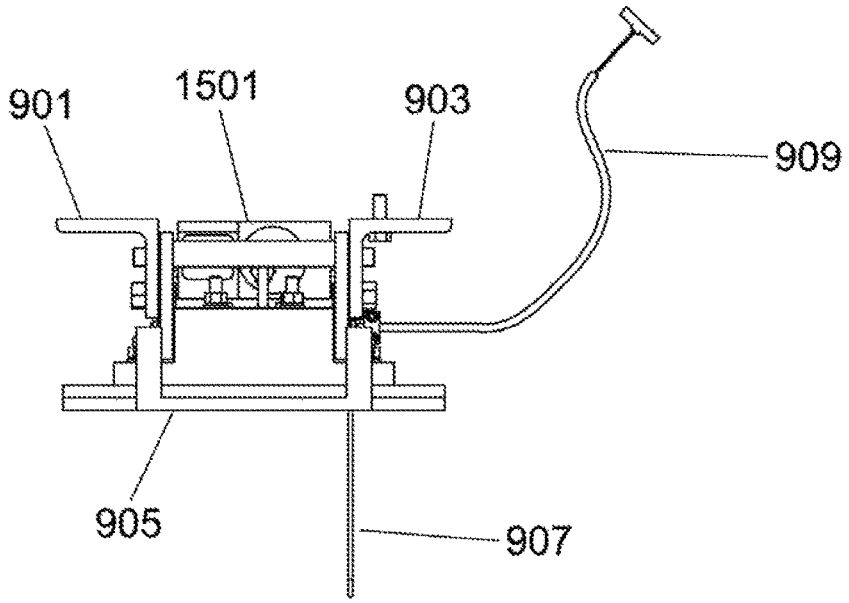
FIG. 16 is a top plan view of the mount of FIG. 9.
Figure 17:
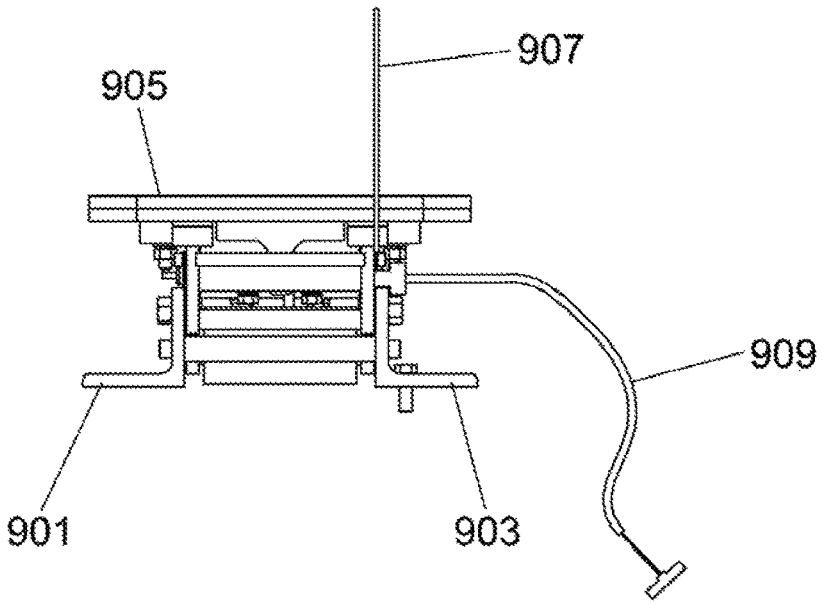
FIG. 17 is a bottom plan view of the mount of FIG. 9.

To better show the hydraulics and the mount, FIG. 16 is a top plan view of the mount of FIG. 9. FIG. 17 is a bottom plan view of the mount of FIG. 9.

Figure 19:
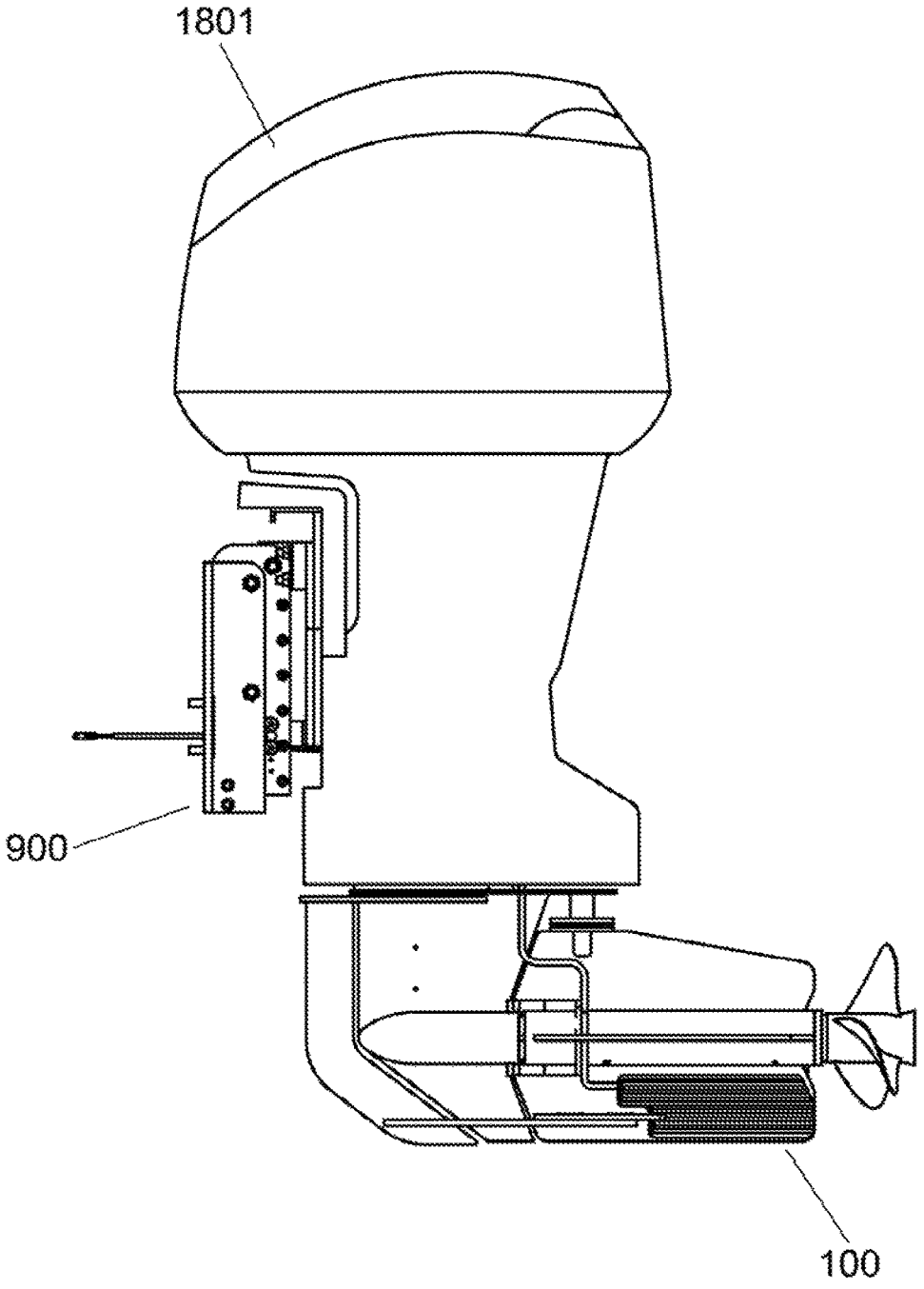
FIG. 19 is a side plan view of the marine propulsion unit of FIG. 18.
Figure 20:
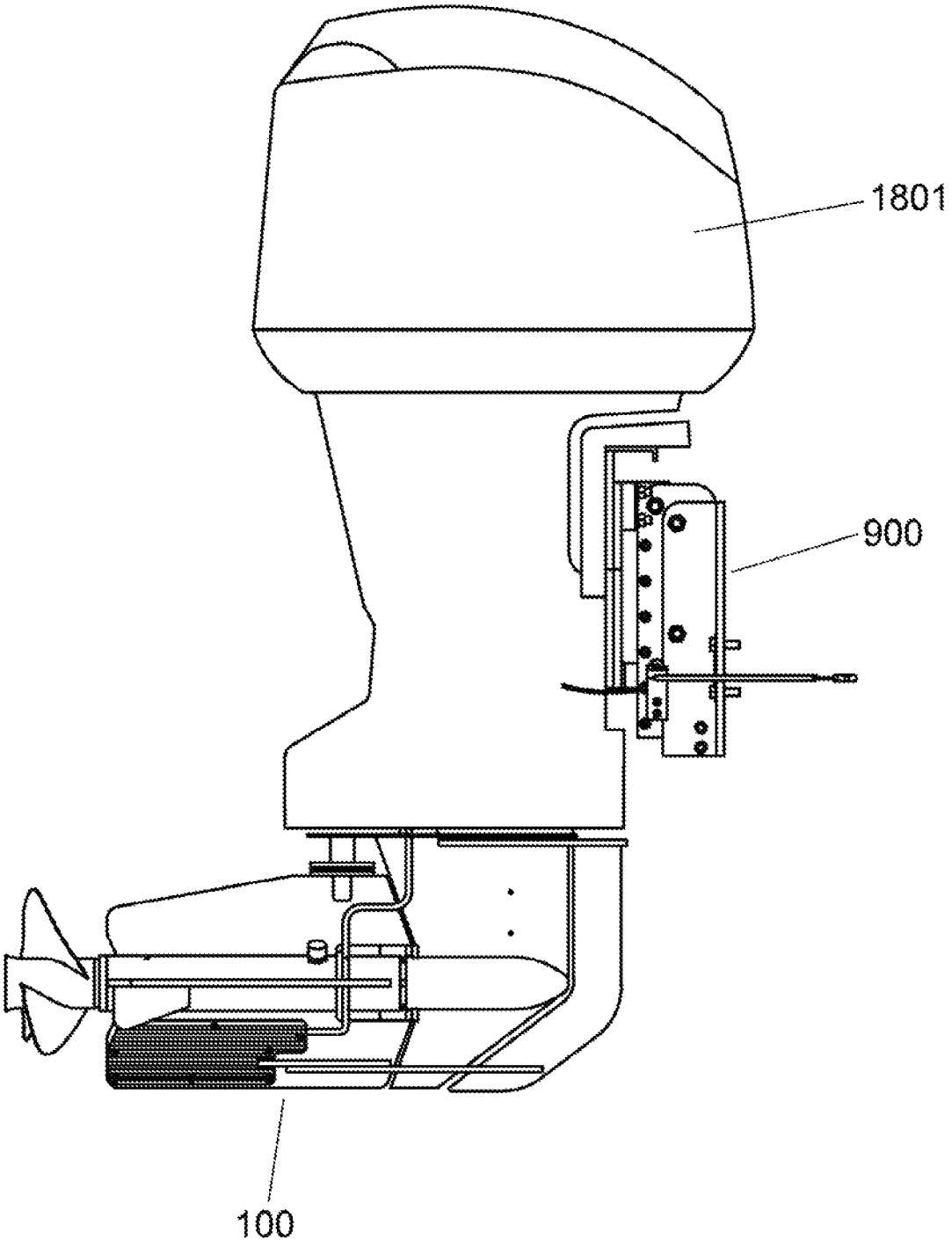
FIG. 20 is an alternate side plan view of the marine propulsion unit of FIG. 18.

FIG. 18 is a perspective view of a marine propulsion unit with mount showing an outboard motor 1801 and related marine propulsion transfer unit 100 with the shallow obstructed water operation mount 900 installed. FIG. 19 is a side plan view of the marine propulsion unit of FIG. 18 and FIG. 20 is an alternate side plan view of the marine propulsion unit of FIG. 18.

Figure 21:
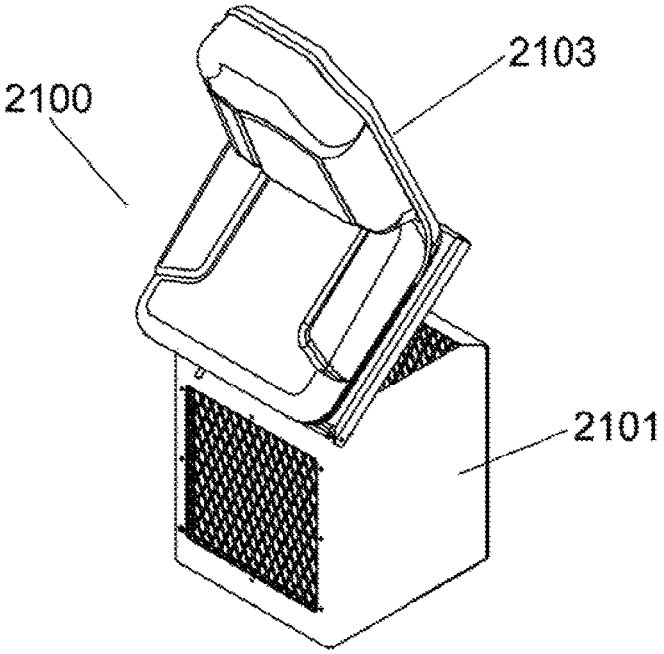
FIG. 21 is a perspective view of a heat exchanging seat of the present invention.
Figure 22:
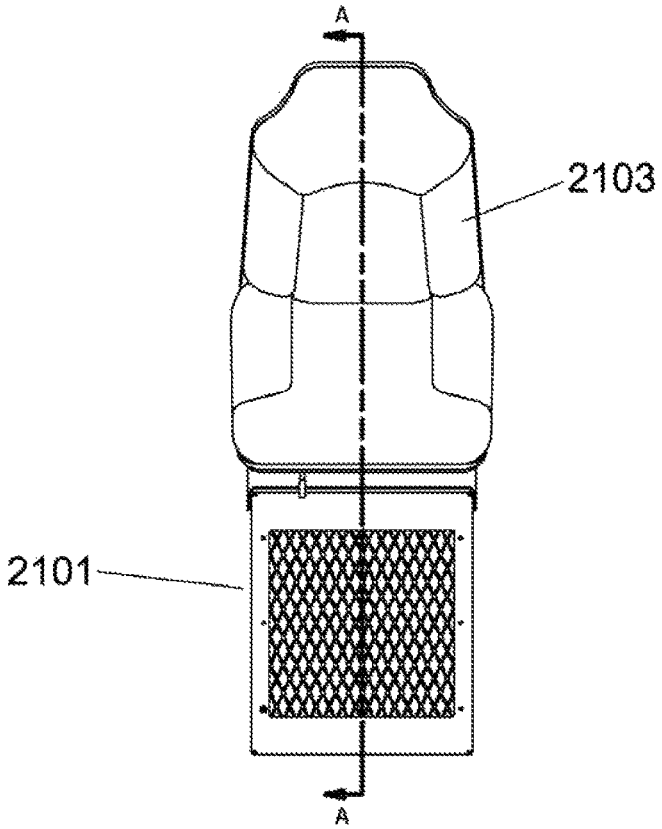
FIG. 22 is a top plan view of the heat exchanging seat of FIG. 21.
Figure 23:
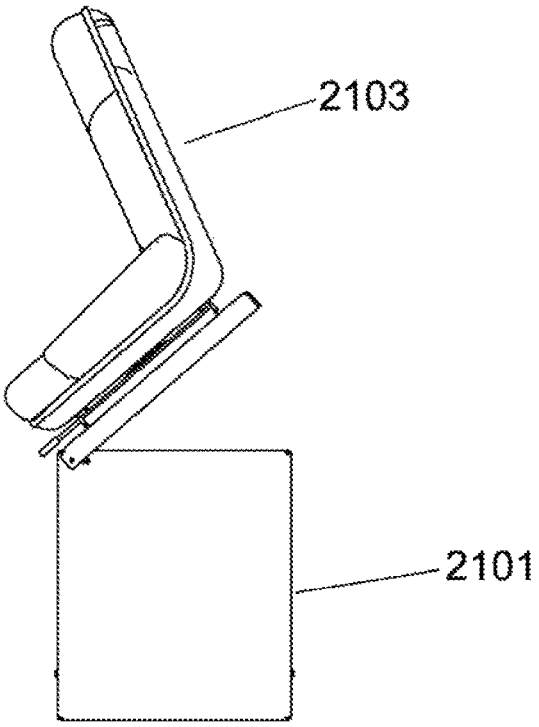
FIG. 23 is a side plan view of the heat exchanging seat of FIG. 21.
Figure 24:
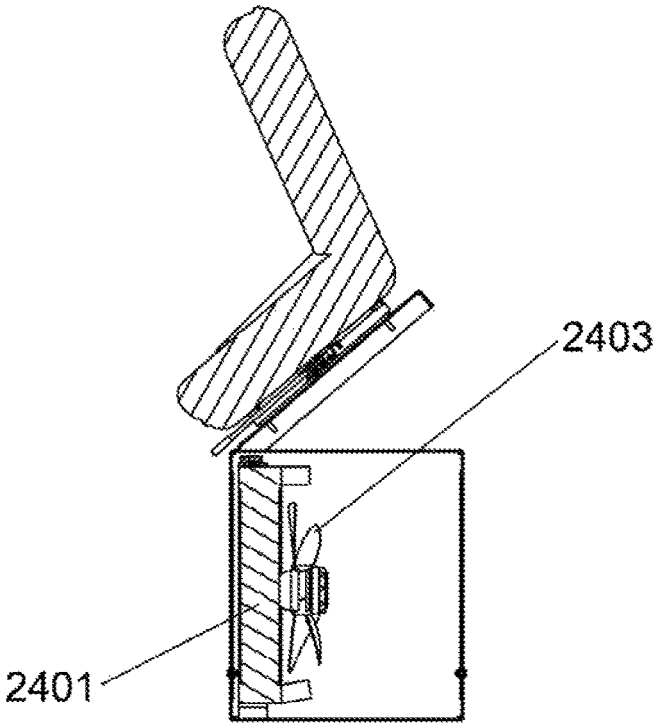
FIG. 24 is a cross sectional view of the heat exchanging seat of FIG. 21 taken along line A-A of FIG. 22.

While the closed loop cooling system of the present invention may utilize a heat exchanger such as the cooling structure 115 depicted in FIG. 1, a heat exchanger such as a radiator and fen arrangement may prove beneficial in some embodiments of the present invention and related operating conditions. The challenge in a marine environment, however, is where to mount such a radiator and fan arrangement. FIG. 21 depicts a novel way in which to provide supplemental closed loop cooling by way of running cooling lines to a radiator installed in a boat seat. Such a "hot seat" or for those of a more technical persuasion a heat exchanging seat 2100 solves the problem of space for such supplemental, and at times necessary, cooling. A pedestal mount 2101 provides an enclosure for the radiator and a seat 2103 can be seen with a hinged or removable mechanism to access the radiator should the need arise. FIG. 21 is therefore a perspective view of a heat exchanging seat of the present invention and FIG. 22 is a top plan view of the heat exchanging seat of FIG. 21. FIG. 23 is a side plan view of the heat exchanging seat of FIG. 21 and FIG. 24 is a cross sectional view of the heat exchanging seat of FIG. 21 taken along line A-A of FIG. 22. FIG. 24 clearly shows the radiator/heat exchanger 2401 and a fan 2403 to provide air movement across and through the radiator 2401. The sides of the pedestal mount 2101 may also have ventilation slots or openings to further improve airflow.

Figure 25:
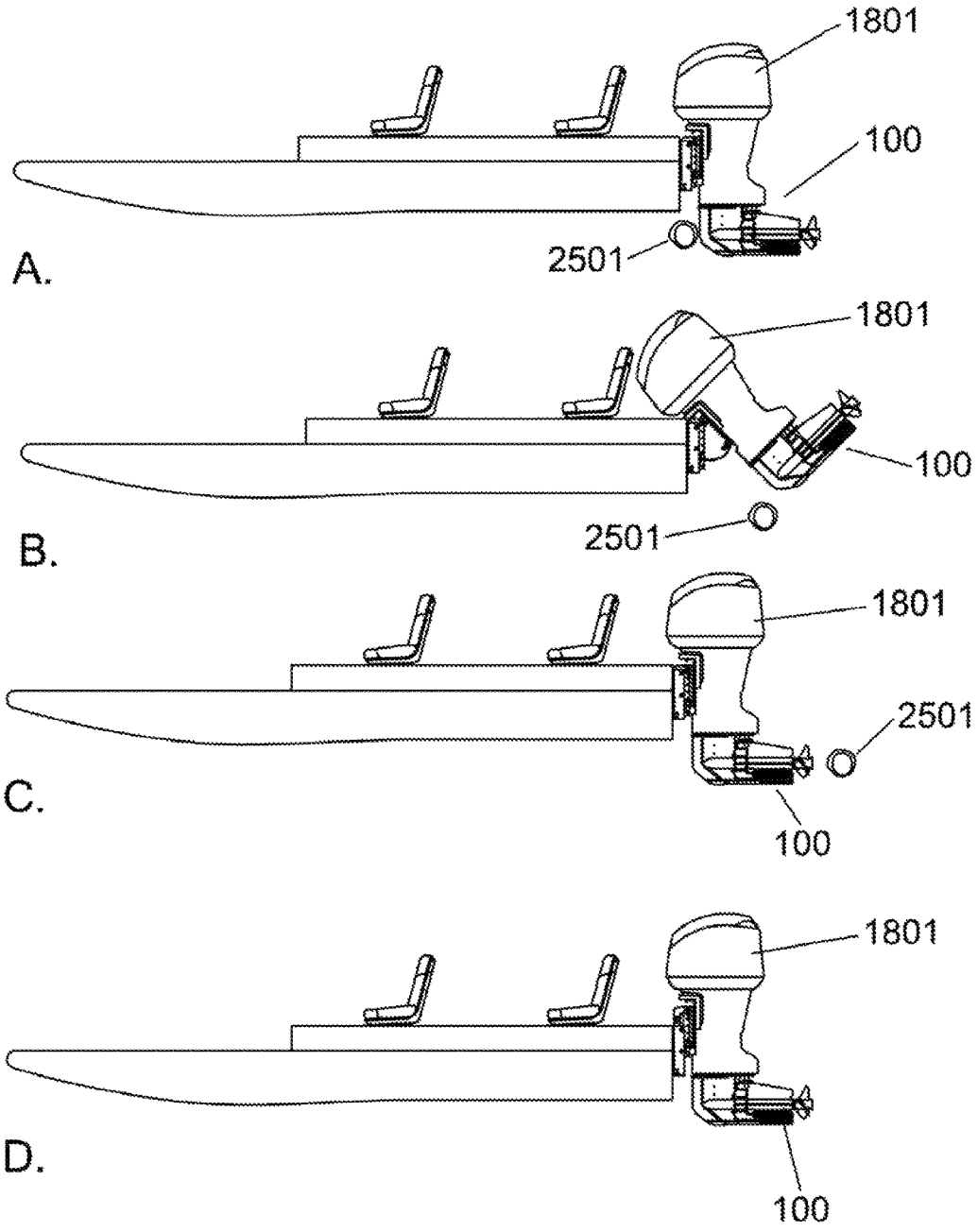
FIG. 25 is sequence of illustrations depicting the marine propulsion unit in use, where A., B., and C. depict the marine propulsion unit striking a log, kicking up over the log, and resuming normal operation, with D. depicting shallow water operation.

FIG. 25 is sequence of illustrations depicting the marine propulsion unit in use, where A., B., and C. depict the marine propulsion unit striking a log or obstruction 2501, kicking up over the obstruction 2501, and resuming normal operation, with D. depicting shallow water operation with the mount in an upper position.

It is, therefore, apparent that there has been provided, in accordance with the various objects of the present invention, a marine propulsion unit, marine propulsion transfer unit, mount, and combinations thereof.

While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims, and drawings appended herein.

What is claimed is:

1. A marine propulsion transfer unit comprising:

driveshaft housing for extending the driveline of an existing outboard motor;

a marine propulsion transfer unit driveline comprising an adapter for axially coupling to a horizontal output shaft of an existing outboard motor driveline, a misalignment coupling, and an output shaft adapted to receive a propeller;

the marine propulsion transfer unit driveline being retained by the driveshaft housing; and at least one attachment to connect the driveshaft housing to the existing outboard motor and extend the existing outboard motor driveline.

2. The marine propulsion transfer unit of claim 1, further comprising an upper support attached to the driveshaft housing.

3. The marine propulsion transfer unit of claim 2, wherein the upper support is an upper support fin.

4. The marine propulsion transfer unit of claim 1, further comprising at least one stabilizer protruding from the driveshaft housing on a generally horizontal plane while in use.

5. The marine propulsion transfer unit of claim 4, wherein the at least one stabilizer comprises an upper stabilizer assembly and a lower stabilizer assembly.

6. The marine propulsion transfer unit of claim 1, further comprising a sealed driveline section.

7. The marine propulsion transfer unit of claim 1, further comprising an open driveline section.

8. The marine propulsion transfer unit of claim 1, further comprising an open driveline section having discharge ports.

9. The marine propulsion transfer unit of claim 1, further comprising a front guard assembly to protect the marine propulsion transfer unit when mounted to an existing outboard motor.

10. The marine propulsion transfer unit of claim 1, further comprising a propeller.

11. The marine propulsion transfer unit of claim 1, further comprising a cooling structure.

12. The marine propulsion transfer unit of claim 1, wherein the marine propulsion transfer further comprises a sacrificial cushion hub.

13. The marine propulsion transfer unit of claim 1, further comprising a torque compensating trim tab.

14. The marine propulsion transfer unit of claim 13, wherein the torque compensating trim tab is adjustable along a thrust vector of the marine propulsion transfer unit.

15. The marine propulsion transfer unit of claim 1, further comprising a garden hose fitting attached to the marine propulsion transfer unit driveline for cleanout of the marine propulsion transfer unit after use.

16. A marine propulsion unit comprising:

an outboard motor a driveline with a horizontal output shaft;

a driveshaft housing for extending the driveline of the outboard motor;

a marine propulsion transfer unit driveline comprising an adapter for axially coupling to the horizontal output shaft of the outboard motor driveline, a misalignment coupling, and an output shaft adapted to receive a propeller;

the marine propulsion transfer unit driveline being retained by the driveshaft housing; and at least one attachment to connect the driveshaft housing to the outboard motor.

17. The marine propulsion transfer unit of claim 16, further comprising a propeller mounted to the output shaft of the marine propulsion transfer unit driveline.

18. The marine propulsion transfer unit of claim 16, further comprising a closed loop cooling system.

19. The marine propulsion transfer unit of claim 18, further comprising a cooling structure attached to the marine propulsion transfer unit and in fluid communication with the closed loop cooling system.

20. The marine propulsion transfer unit of claim 18, further comprising a mechanical pump to provide fluid circulation in the closed loop cooling system.

21. The marine propulsion transfer unit of claim 18, further comprising a heat exchanger in fluid communication with the closed loop cooling system, wherein the heat exchanger is mounted within a marine vessel.

22. A kit for converting an existing outboard motor to an outboard motor for shallow obstructed water operation, the kit comprising:

the marine propulsion transfer unit of claim 1; and a mount for shallow obstructed water operation of the marine propulsion transfer unit, the mount comprising a transom mount, an outboard motor mount plate slidably engaged with the transom mount to vertically raise and lower an outboard motor, a submerged obstruction binge assembly, and a reverse lockout component.

23. A marine propulsion unit comprising:

an outboard motor having a driveline with a horizontal output shaft;

a mount for shallow obstructed water operation of the marine propulsion transfer unit, the mount comprising a transom mount, an outboard motor mount plate slidably engaged with the transom mount to vertically raise and lower an outboard motor, a submerged obstruction hinge assembly, and a reverse lockout component;

a driveshaft housing for extending the driveline of the outboard motor;

a marine propulsion transfer unit driveline comprising an adapter for axially coupling to the horizontal output shaft of the outboard motor driveline, misalignment coupling, and an output shaft adapted to receive a propeller;

the marine propulsion transfer unit driveline being retained by the driveshaft housing; and at least one attachment to connect the driveshaft housing to the outboard motor.

* * * * *